US011091988B2

(12) United States Patent
Ejim et al.

(10) Patent No.: US 11,091,988 B2
(45) Date of Patent: Aug. 17, 2021

(54) DOWNHOLE SYSTEM AND METHOD FOR SELECTIVELY PRODUCING AND UNLOADING FROM A WELL

(71) Applicant: Saudi Arabian Oil Company, Dhahran (SA)

(72) Inventors: Chidirim Enoch Ejim, Dhahran (SA); Brian Andrew Roth, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 21 days.

(21) Appl. No.: 16/654,863

(22) Filed: Oct. 16, 2019

(65) Prior Publication Data

US 2021/0115772 A1 Apr. 22, 2021

(51) Int. Cl.

| | |
|---|---|
| ***E21B 43/12*** | (2006.01) |
| ***E21B 43/38*** | (2006.01) |
| ***E21B 34/06*** | (2006.01) |
| ***E21B 47/04*** | (2012.01) |

(52) U.S. Cl.

CPC ..... *E21B 43/12* (2013.01); *E21B 34/06* (2013.01); *E21B 43/128* (2013.01); *E21B 43/38* (2013.01); *E21B 47/04* (2013.01)

(58) Field of Classification Search

CPC ..... E21B 43/38; E21B 43/128; E21B 47/04; E21B 34/06; E21B 34/08; E21B 43/123

See application file for complete search history.

(56) References Cited

U.S. PATENT DOCUMENTS

| | | | | |
|---|---|---|---|---|
| 642,562 | A | | 1/1900 | Probert |
| 4,502,536 | A | * | 3/1985 | Setterberg, Jr. ..... E21B 43/12 166/105.5 |
| 4,632,184 | A | * | 12/1986 | Renfroe, Jr. ..... E21B 43/121 166/105.5 |
| 5,211,242 | A | | 5/1993 | Coleman |
| 5,634,522 | A | | 6/1997 | Hershberger |
| 5,755,288 | A | | 5/1998 | Bearden et al. |
| 6,021,849 | A | | 2/2000 | Averhoff |
| 6,082,452 | A | * | 7/2000 | Shaw ..... B04C 5/00 166/105.5 |

(Continued)

OTHER PUBLICATIONS

International Search Report issued in the prosecution of international patent application No. PCT/US2020/055433, dated Dec. 7, 2020, 14 pages.

*Primary Examiner* — Brad Harcourt

(74) *Attorney, Agent, or Firm* — Bracewell LLP; Constance Gall Rhebergen

(57) ABSTRACT

A downhole system and method for producing and unloading from a well unloads a first fluid through a tubular in the well while blocking flow of a second fluid into the tubular. In an alternate mode, the second fluid is produced through the tubular while the first fluid is blocked from entering the tubular. In another alternate mode, a third fluid is unloaded through the tubular at the same the second fluid is produced from the well and through the tubular. In yet another alternate mode, the second fluid is pressurized downhole. In one example, the first fluid includes water, the second fluid includes a hydrocarbon gas, and the third fluid includes a hydrocarbon liquid. Means for unloading include a pump, means for pressurizing the second fluid include a compressor, and means for selectively blocking flow includes a flow circuit with one-way valves.

19 Claims, 5 Drawing Sheets

(56) References Cited

U.S. PATENT DOCUMENTS

| | | | | |
|---|---|---|---|---|
| 6,497,287 | B1 | 12/2002 | Podio | |
| 6,533,039 | B2 | 3/2003 | Rivas | |
| 7,363,983 | B2 | 4/2008 | Martinez et al. | |
| 7,748,448 | B2 | 7/2010 | Bender | |
| 8,066,077 | B2 | 11/2011 | Lawson | |
| 8,113,274 | B2 * | 2/2012 | Rivas | E21B 43/128 166/106 |
| 8,448,699 | B2 | 5/2013 | Camilleri | |
| 9,045,976 | B2 | 6/2015 | Hallundbaek | |
| 9,915,134 | B2 | 3/2018 | Xiao et al. | |
| 2005/0175476 | A1 | 8/2005 | Patterson | |
| 2005/0230121 | A1 * | 10/2005 | Martinez | E21B 43/122 166/372 |
| 2008/0245525 | A1 | 10/2008 | Rivas et al. | |
| 2009/0211753 | A1 | 8/2009 | Emtiazian et al. | |
| 2010/0258306 | A1 | 10/2010 | Camilleri et al. | |
| 2011/0297391 | A1 | 12/2011 | Fielder et al. | |
| 2014/0209318 | A1 | 7/2014 | Rouen | |
| 2014/0377080 | A1 * | 12/2014 | Xiao | E21B 43/38 417/53 |
| 2017/0183948 | A1 | 6/2017 | Xiao et al. | |

* cited by examiner

DOWNHOLE SYSTEM AND METHOD FOR SELECTIVELY PRODUCING AND UNLOADING FROM A WELL

BACKGROUND OF THE INVENTION

1. Field of Invention

The present disclosure relates to unloading a fluid from a hydrocarbon producing well. More specifically, the present disclosure relates to unloading liquid from a hydrocarbon producing well; and also producing gas hydrocarbon from the well without adding or removing equipment to or from the well.

2. Description of Prior Art

Hydrocarbons trapped in a subterranean formation are typically extracted by excavating a wellbore from surface that intersects the formation; and producing the hydrocarbons by directing them up the wellbore to surface. The wellbore is usually completed prior to hydrocarbon production, which generally involves lining most of the wellbore with casing, inserting production tubing inside the casing, and installing a production tree for controlling pressure in the wellbore and distributing produced fluids from the wellbore. Artificial lift is sometimes employed when pressure in the formation is insufficient to drive the hydrocarbons up the wellbore to surface. Types of artificial lift currently in use include electrical submersible pumps, jet/hydraulic pumps, sucker rods, compressors and gas lift.

Gas wells can sometimes experience an accumulation of liquid, such as hydrocarbon condensate or connate water from the formation. If the accumulation is sufficient, gas flow into the well is sometimes impeded that in turn reduces the amount of gas from the well. In more severe instances, the amount of liquid accumulated in the well prevents gas from flowing into the well thereby ceasing production. A well having an amount of accumulated liquid sufficient to affect gas production is sometimes referred to as a loaded well; similarly, removing the accumulated liquid is referred to as unloading a well. Wells that produce an appreciable amount of liquid are usually equipped with liquid artificial lift systems, which can sometimes unload a well without the need for intervention. Wells that produce primarily gas often do not include means for unloading liquids, and usually require a well intervention procedure to unload accumulated liquid. One technique currently employed for unloading accumulated liquid from a well involves injecting nitrogen into the well through coiled tubing; which is costly and can be a safety risk to operations personnel. Accordingly, a need exists for a cost effective and safe way to unload liquid accumulated in a gas well.

SUMMARY OF THE INVENTION

Disclosed is an example of a downhole system for handling fluids in a well and which includes a submersible pump having a pump inlet in communication with liquid in the well and a pump discharge selectively at a pressure that is greater than a pressure at the pump inlet, and a fluids handling circuit. The fluids handling circuit of this example includes a pump discharge line having an inlet in fluid communication with the pump discharge and an exit in selective communication with a bore that is inside of production tubing installed in the well, a gas feed line having an inlet in communication with gas in the well and an outlet in selective communication with the bore, a barrier to a flow from the gas feed line to the pump, and a barrier to a flow of a fluid from the pump discharge line to the inlet of the gas feed line. In an example, a barrier is included between a flow in the gas feed line to the pump, and which is a one-way valve in the pump discharge line, and wherein the barrier between a flow of a fluid in the pump discharge line to the inlet of the gas feed line is a one-way valve in the gas feed line. In this example, the one-way valve in the pump discharge line is selectively openable when a pressure in the pump discharge line is at least as great as a pressure in the gas feed line so that fluid discharged from the pump flows into the bore to define an unloading mode. In an alternative, the one-way valve in the gas feed line is selectively openable when a pressure in the gas feed line is at least as great as a pressure in the pump discharge line so that fluid in the gas feed line flows into the bore to define a production mode. In this example, the fluid in the pump discharge line includes liquid (condensate and/or connate water) accumulated in the well, and wherein the system is in the production mode when the liquid in the well is below a first designated liquid level, and wherein the system is in the unloading mode when the liquid in the well is above a second designated liquid level. In an embodiment the fluids handling circuit is in a crossover bulkhead. In an embodiment, the system includes a compressor having a compressor inlet in fluid communication with gas in the well through a compressor inlet line disposed in a lower bulkhead, and a compressor discharge that is selectively at a pressure greater than a pressure in the well, and where the fluids handling circuit further includes a compressor discharge line having an end in communication with the compressor discharge and that is in fluid communication with the bore. One example of the system includes a barrier to a flow from the gas feed line to the compressor, and a barrier to a flow of a fluid from the pump discharge line to the compressor. In an embodiment, a fluid flowing in the bore is fluid from two or more of fluid flowing through the gas inlet line, fluid being discharged from the compressor, and fluid being discharged from the pump.

An alternate example of a downhole system for handling fluids in a well is disclosed and which includes a submersible pump having a liquid inlet in fluid communication with liquid in the well, a gas feed line having a gas inlet in fluid communication with gas in the well, and a fluids handling circuit. The fluids handling circuit of this example includes an upstream end in communication with a discharge of the submersible pump and an end of the gas feed line distal from the inlet of the gas feed line, a downstream end in communication with the upstream end and also in communication with a bore of a production tubular installed in the well, and barriers that block a flow of fluid from within the fluids handling circuit to the gas inlet and to the submersible pump. In an example, the pump is driven by a pump motor, and wherein pressure in the motor is equalized to pressure in the well with a pump seal, and wherein the pump, pump motor, and pump seal define an electrical submersible pumping assembly, the system further comprising a pod circumscribing a portion of the pumping assembly, and wherein fluid discharged from the pump flows through a pump discharge line that is routed through the pod. In an example, a cross over assembly is included in which the fluids handling circuit is disposed, and wherein the inlet of the gas feed line is flush with an outer surface of the cross over assembly. Embodiments exist having a compressor with a compressor inlet in communication with gas in the well, a compressor exit in communication with the fluids handling circuit, a barrier that blocks flow from the fluids handling circuit to the exit, and wherein the compressor is selectively operated in a standby mode so that pressure at the compressor exit and inlet are substantially the same, selectively operated in a first operational mode so that pressure at the compressor exit exceeds a pressure at the compressor inlet, and selectively operated in a second operational mode so that pressure at the compressor exit exceeds a pressure at the compressor inlet and fluid in the production tubing comprises a mixture of gas discharged from the compressor and liquid discharged from the pump.

Also disclosed is a method of handling fluid in a well that includes operating in an unloading mode by directing a pressurized liquid within a pressurized liquid flow path within a downhole assembly and to a bore of a production tubular that is installed in the well, and flowing the pressurized liquid through the bore to a wellhead assembly set over the well, operating in a production mode when not operating in the unloading mode by directing gas from within the well and through a gas flow path within the downhole assembly and to the bore, blocking a flow of the pressurized liquid from entering the gas flow path when in the unloading mode, and blocking a flow of the gas from entering the pressurized liquid flow path when in the production mode. The method optionally includes monitoring an amount of a liquid in the well, and operating in the unloaded mode when a level of the liquid in the well is above a designated liquid level, and wherein the pressurized liquid comprises liquid in the well that is pressurized by a pump in the well. The method also optionally includes monitoring an amount of a liquid in the well, and operating in the production mode when a level of the liquid in the well is below a designated liquid level. In an alternative, the method includes operating in a gas production mode by directing pressurized gas from within the well through a pressurized gas flow path within the downhole assembly and to the bore, blocking a flow of the pressurized gas from entering the gas flow path, and blocking a flow of the pressurized gas from entering the pressurized liquid flow path, and wherein the step of operating in the gas production mode is performed when not in the unloading mode. This example further optionally includes operating in a mixed production mode by directing a pressurized liquid along the pressurized fluid path to the bore while also operating in the unloading mode. In one embodiment, a pump is used in the well to pressurize the liquid in the well to define the pressurized liquid, using a compressor in the well to pressurize the gas. Examples exist where the pressurized liquid includes hydrocarbons, water, or a combination.

BRIEF DESCRIPTION OF DRAWINGS

Some of the features and benefits of the present invention having been stated, others will become apparent as the description proceeds when taken in conjunction with the accompanying drawings, in which.

Figure 1A:
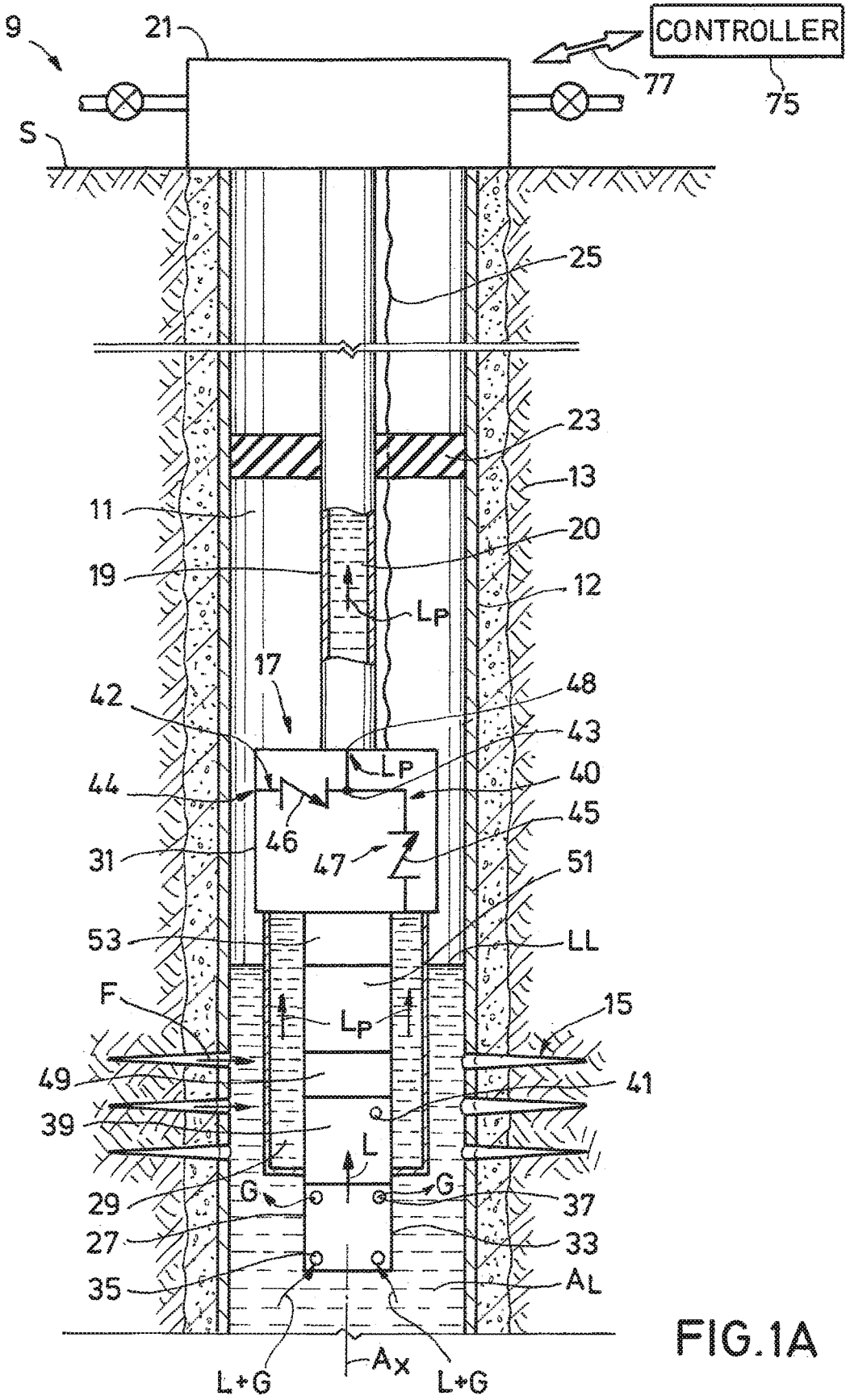
FIGS. 1A and 1B are side sectional views of an example of an unloading system disposed in a wellbore and in different operating modes.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1B:
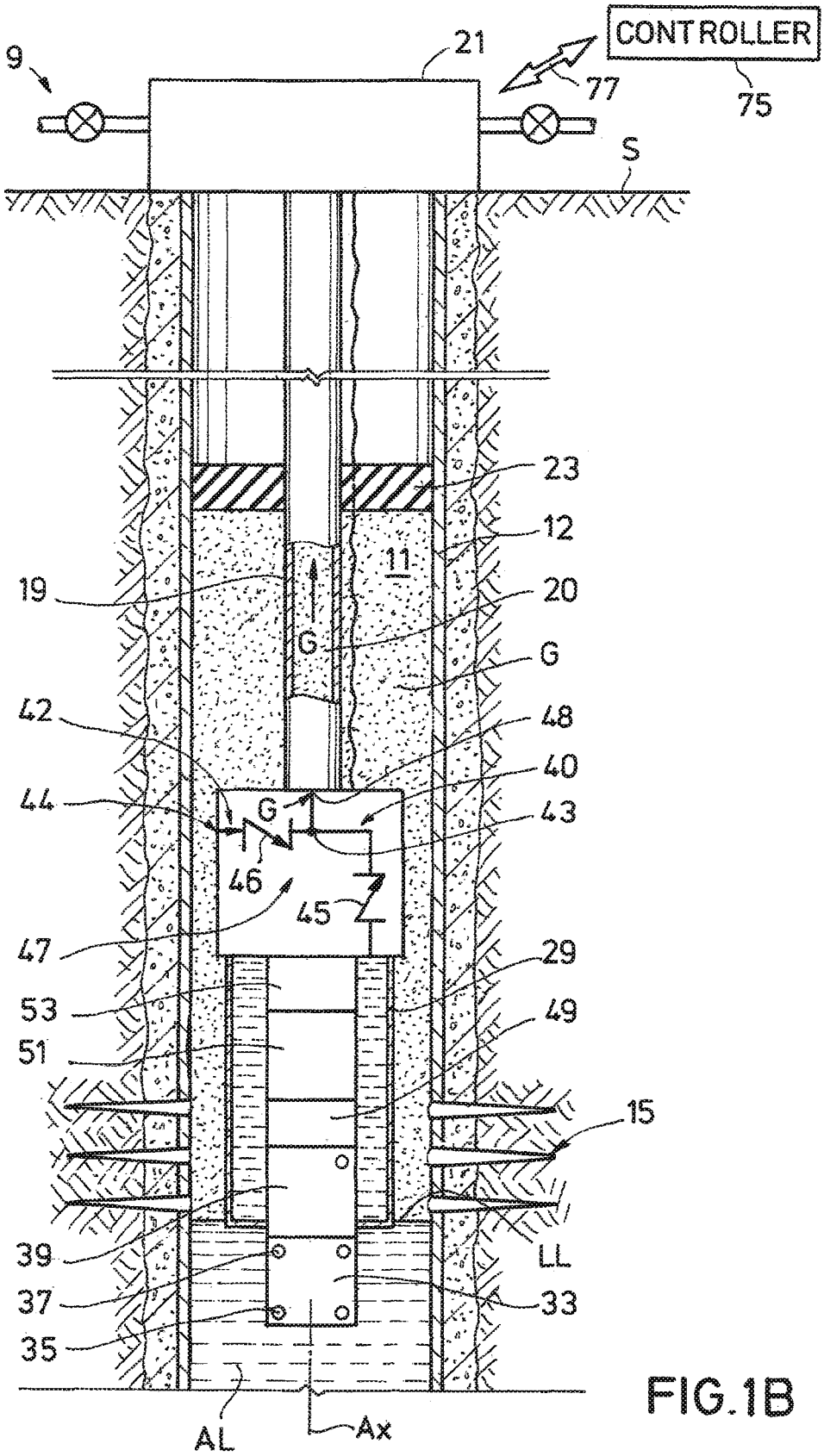

Shown in partial side sectional views in FIGS. 1A and 1B is a schematic example of a downhole system 9 for use in unloading and producing from a wellbore 11 that is lined with casing 12. In FIG. 1A, downhole system 9 is shown in a loaded mode, and in use for unloading liquid from within wellbore 11 that has accumulated. In the illustrated example, fluid F enters wellbore 11 from a formation 13 surrounding wellbore 11 and through perforations 15 shown radially outward from wellbore 11, through casing 12, and into formation 13. In the illustrated examples, fluid F primarily includes gas with amounts of liquid. As shown in FIG. 1A, liquid included with fluid F collects within wellbore 11 over time; which is referred to herein as accumulated liquid AL. Embodiments exist where an amount of gas or vapor is included within the accumulated liquid AL. An upper surface of the accumulated liquid AL is at a height or location within wellbore 11 which defines a liquid level LL of the accumulated liquid AL in wellbore 11. Further shown is that the liquid level LL is above the perforations 15. As illustrated in FIGS. 1A and 1B, liquid level LL is substantially perpendicular with axis $A_X$ of wellbore 11. Alternate examples exist where liquid level LL is oblique with axis $A_X$ of wellbore 11, such as when the liquid level LL is in a deviated portion of wellbore 11. Further optionally, embodiments exist where perturbations of fluid F flowing into wellbore 11 disrupt the surface of the liquid level LL. Included with the downhole system 9 is a downhole assembly 17 which is illustrated mounted to a lower end of production tubing 19 that is installed within the wellbore 11. Inside tubing 19 is a bore 20 and through which liquid L is transported to a wellhead assembly 21 shown on surface S and mounted over an opening of the wellbore 11. In an example, liquid L is obtained from the accumulated liquid AL; and a packer 23 is illustrated in the annular space between tubing 19 and sidewalls of wellbore 11 and uphole from downhole assembly 17. A power cable 25 is shown within wellbore 11 and along the outer surface of the production tubing 19. In an example, electricity and/or signals are communicated along power cable 25 between surface S and the downhole assembly 17.

An example of a lift system 27 is schematically illustrated, and which is part of the downhole assembly 17. A pod 29 circumscribes a portion of lift system 27 and in one example is made up of an outer housing that forms a cavity. Also schematically illustrated is one example of a cross over bulkhead 31, and which is shown on an end of the downhole assembly 17 adjacent production tubing 19. On a lowermost end of the lift system 27 a schematic example of a gas separator 33 is shown. Inlet ports 35 are illustrated formed along an outer surface of gas separator 33; in an example of operation, accumulated liquid AL is drawn into ports 35, and inside gas separator 33 gas G is removed from within accumulated liquid AL. The gas G separated from the accumulated liquid AL is discharged back into wellbore 11 from the gas separator 33 through gas discharge ports 37 shown on an outer surface of the separator 33. Liquid L results from removing gas G from accumulated liquid AL; liquid L exits the separator 33 and is directed to a pump 39 that is schematically illustrated on a side of separator 33 proximate production tubing 19. Discharge fluid exiting pump 39 flows through pod 29 towards upper bulkhead 31 and is directed into a line 40 within upper bulkhead 31.

Still referring to FIG. 1A, inside the crossover bulkhead 31 line 40 is intersected by a gas feed line 42 at a junction 43. In alternate embodiments, each of lines 40, 42 connect directly into tubing 19 and communicate separately into bore 20, line 40 intersects into line 42, or lines 40, 42 terminate at a manifold (not shown) that is in communication with bore 20. An inlet 44 is shown on an end of the gas feed line 42 distal from junction 43. Inlet 44 in the example of FIG. 1A projects radially outward from an outer surface of the crossover bulkhead 31. Alternate embodiments exist where the inlet 44 is substantially flush with or recessed within the outer surface of the cross over bulkhead 31. One-way valves 45, 46 are shown disposed respectively in lines 40, 42. One-way valve 45 allows flow in pump discharge line 40 in a direction from inlet 41 to junction 43, and blocks fluid downstream of one-way valve 45 (i.e. on a side of one-way valve 45 opposite inlet 41) from flowing towards pump 39. Similarly, one-way valve 46 allows flow in gas feed line 42 from inlet 44 to junction 43, and blocks fluid that is downstream of one-way valve 46 (i.e. on a side of one-way valve 46 opposite from inlet 44) from flowing towards inlet 44. In the illustrated example, the lines 40, 42 and one-way valves 45, 46 define a fluids handling circuit 47. Further illustrated in the example of FIG. 1A is where an outlet 48 of the fluids handling circuit 47 connects to an end of production tubing 19 in the wellbore 11 and opposite wellhead assembly 21. In this example, the outlet 48 is in fluid communication with bore 20, as such the pump discharge and inlet 44 to the gas feed line 42 are in selective communication with bore 20 through the fluids handling circuit 47 and its outlet 48.

A pump seal 49 is illustrated on a side of pump 39 opposite from the gas separator 33 and which provides a pressure equalizing functionality for a pump motor 51 which is also schematically illustrated within the lift system 27 and on a side of the pump seal 49 opposite from pump 39. In an alternative, a monitoring sub 53 is set between the pump motor 51 and cross over bulkhead 31. Examples of the monitoring sub 53 exists where the monitoring sub 53 includes sensors for monitoring conditions downhole, such as temperature and pressure, and also in one alternative include systems for monitoring functions of the pump motor 51 and pump 39.

Referring now to FIG. 1A, as noted above liquid level LL of accumulated liquid AL is above perforations 15; and which in the illustrated example impedes flow of fluid F from perforations of gas into wellbore 11. For the purposes of illustration, wellbore 11 of FIG. 1A is in a loaded condition. In a non-limiting example of operation, wellbore 11 is changed from its loaded condition by activating pump 39 by energizing motor 51. Further in this example, activating pump 39 drives impellers (not shown) within pump 39 that pressurize liquid L received by pump 39 to form pressurized liquid $L_P$, and drive the pressurized liquid $L_P$ through the pump discharge line 40, the fluids handling circuit 47, and into the bore 20 where the pressurized fluid $L_P$ is delivered to the wellhead assembly 21. In the example of FIG. 1A downhole system 9 is in what is referred to as an unloading mode. At wellhead assembly 21, the pressurized liquid $L_P$ is selectively directed to offsite facilities, or facilities adjacent the well site for further processing. In one example, liquid L includes primarily water, yet other examples include where liquid L is hydrocarbon that has condensed within wellbore 11 and accumulated over time. In an example, a decision to operate the downhole system 9 in the unloading mode is based on a height of the liquid level LL or its location within wellbore 11. Example heights or locations triggering the decision to operate in the unloading mode described herein include when liquid level LL is above all perforations 15, when liquid level LL is between perforations 15, or the liquid level LL is below all of perforations 15. It is believed it is within the capabilities of those skilled to determine a suitable liquid level LL for prompting a decision to move to an unloading mode within wellbore 11. In an example, a pressurized liquid flow path is defined along the route taken by pressurized liquid $L_P$ between the discharge of the pump 39 and to the outlet 48.

Shown in the example of FIG. 1B is the downhole system 9 in a production mode where gas G within wellbore 11 flows into the gas feed line 42 through the inlet 44, and within the fluids handling circuit 47 is directed into the bore 20 for transport to the wellhead assembly 21. In an example, a gas flow path is defined along the route taken by gas G flowing from within the wellbore 11 and to the outlet 48. In the production mode pump 39 is not being operated and liquid L is not being lifted to surface S. Similar to the unloading mode, in the production mode gas G flowing inside bore 20 to wellhead assembly 21 is directed from within wellhead assembly 21 to lines for transporting the gas away from the wellsite. While in the flow circuit 47, one-way valve 45 in the pump discharge line 40 prevents the gas G from flowing through the pump discharge line 40 and back to the pump 39. Further shown in the example of FIG. 1B is that liquid level LL has dropped to below perforations 15 and so that production of gas from wellbore 11 is not impeded by the accumulation of the liquid within wellbore 11. In a non-limiting example of operation, the downhole assembly 17 is part of the initial installation when completing the wellbore 11. In an alternative, the downhole assembly 17 is added into wellbore 11 after wellbore 11 has been producing for a period of time, and where the conditions of the gas being produced, such as its pressure and volume, allow for an amount of accumulated liquid L in the wellbore 11 dictating a step of unloading with sufficient regularity to justify the expense of adding the downhole assembly 17. An advantage of the downhole assembly 17 over that of other known ways of unloading gas wells is that liquid unloading is possible without the need to suspend production of gas G from wellbore 11 for a lengthy period of time.

Figure 2A:
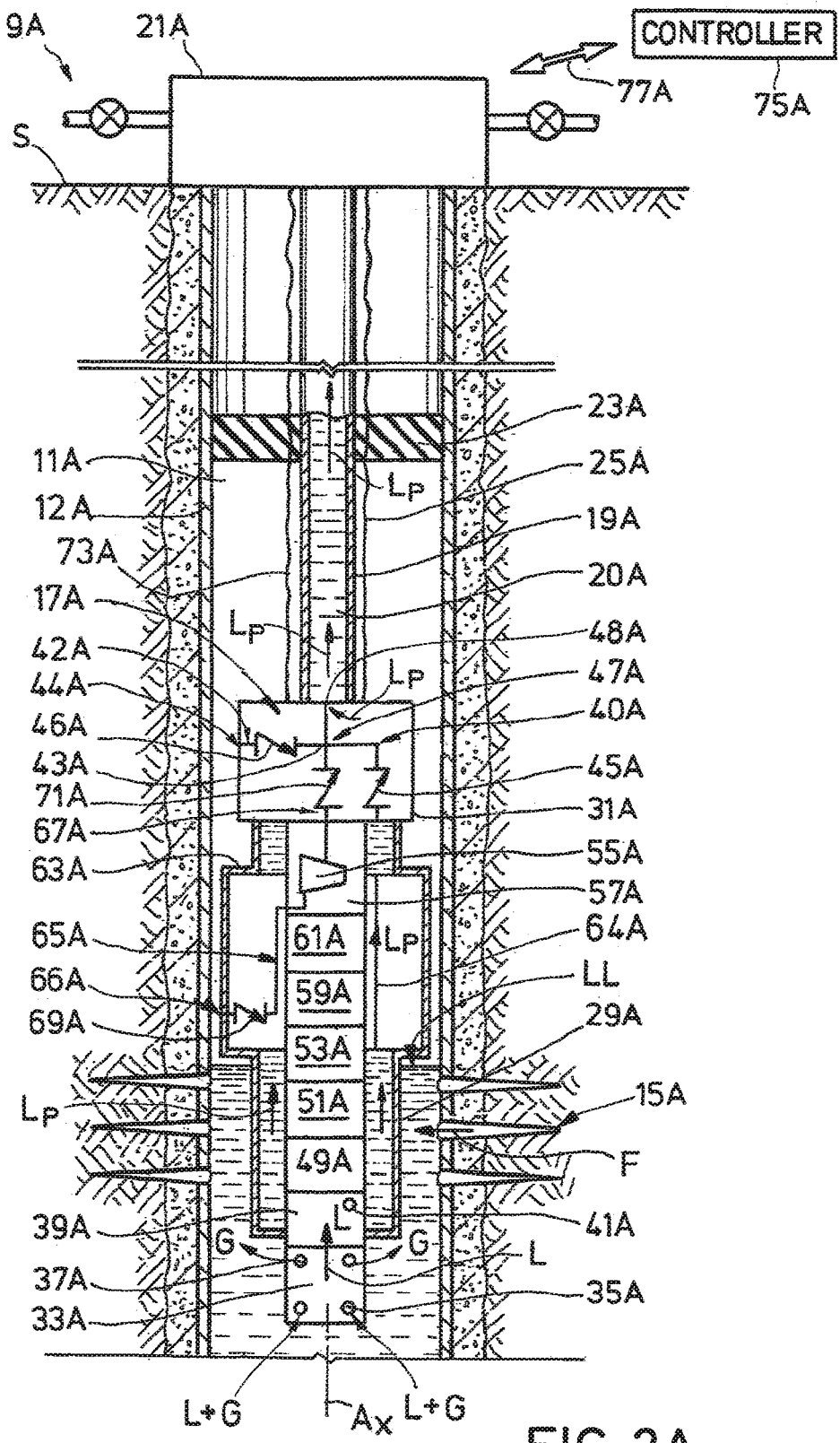
FIGS. 2A-2C are side sectional views of an alternate example of an unloading system disposed in a wellbore and in different operating modes.
Figure 2B:
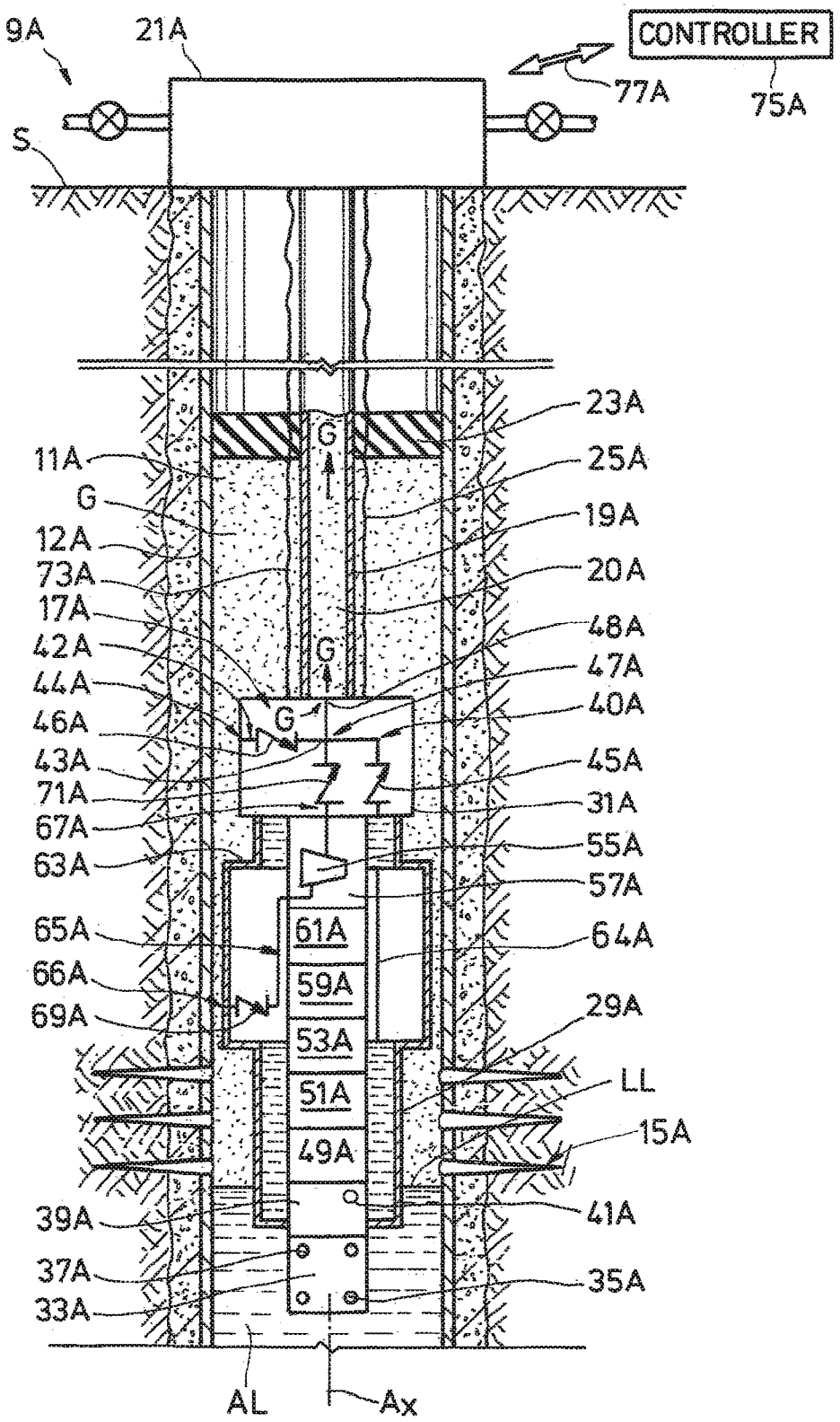
Figure 2C:
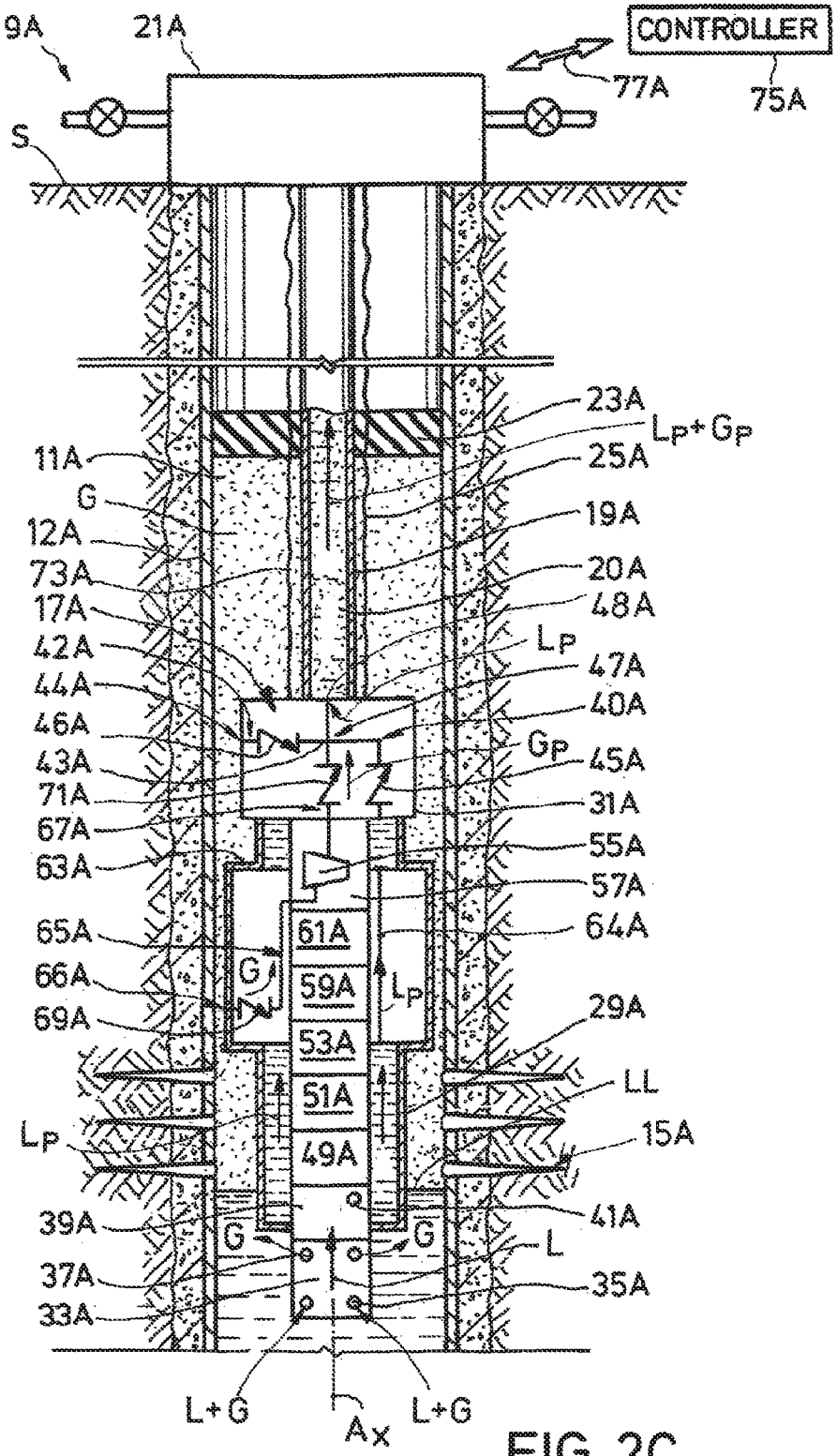

An alternative embodiment of a portion of the downhole system 9A having the downhole assembly 17A is shown in side sectional view in FIGS. 2A through 2C. Also illustrated are examples of additional modes of operation. In the example of FIG. 2A, a compressor 55A is included with the downhole assembly 17A and which is set in a compressor section 57A and shown adjacent the cross over sub 31A and on a side opposite from where cross over sub 31A attaches to tubing 19A. Also included in this example is a compressor motor 59A for driving compressor 55A and a compressor seal 61A for equalizing pressure in the compressor motor 59A. In an alternative, compressor seal 61A also absorbs thrust loads from compressor 55A. In this example, compressor seal 61A is on a side of compressor section 57A opposite from crossover assembly 31A and compressor motor 59A is on a side of compressor seal 61A opposite from the compressor section 57A. Monitoring sub 53A is illustrated set adjacent a side of the compressor motor 59A opposite the compressor seal 61A. Also included in the example illustrated in FIGS. 2A through 2C is a lower cross over bulkhead 63A which circumscribes a portion of the pod 29A. Inlet 66A on the compressor inlet line 65A is shown projecting radially outward from an outer surface of pod 63A and on a side opposite from where compressor inlet line 65A next to an inlet of the compressor 55A. Alternate examples exist in which inlet line 65A terminates at or within housing of lower cross over bulkhead 63A, and inlet 66A is flush or within the outer surface of bulkhead 63A. A passage 64A is shown formed axially through bulkhead 63A to allow a flow of liquid L from pump 39A.

In the illustrated example, a compressor discharge line 67A connects to a discharge of compressor 55A on one end and to junction 43A on its other. In this embodiment, the compressor discharge line 67A makes up part of the fluids handling circuit 47A of FIGS. 2A through 2C. It should be pointed out that embodiments of the piping arrangement exist that are different from the lines meeting at junction 43A; alternatively, in an alternative lines 40A, 67A, 42A are in communication with bore 20A of production tubing 19A through a manifold-type arrangement, in another alternative lines 40A, 67A, 42A join one another at different locations on their way to the bore 20A. In the illustrated example, a one-way valve 69A is disposed in line 65A and that allows flow through line 65A from inlet 66A to compressor 55A, and blocks flow of fluid downstream of one-way valve 69A (i.e. on a side of one-way valve 69A opposite inlet 66A) from flowing to inlet 66A. Similarly, a one-way valve 71A in line 67A allows flow in line 67A flowing from compressor 55A towards junction 43A and blocks a flow of fluid downstream of one-way valve 71A (i.e. on a side of one-way valve 71A opposite compressor 55A) towards compressor 55A. Examples exist where each of one-way valves 45, 46 (FIG. 1A) and 45A, 46A, 69A, 71A (FIG. 1B), are check valves, motor operated valves, hydraulically actuated valves, or combinations thereof. Further optionally, one-way valves 45, 46, 45A, 46A, 69A, 71A are controlled to open and close in sequences that are consistent with the designated operating mode of the downhole system 9, 9A. Further illustrated in FIGS. 2A through 2C is a second power line 73A that in one example is used for powering the compressor motor 59A as well as providing signal communication from the downhole assembly 17A into surface.

Referring now to FIG. 2A, liquid level LL of accumulated liquid AL is shown above perforations 15A; which in an alternative is at or above a designated liquid level of accumulated liquid within wellbore 11A, or set point, which triggers the downhole assembly 17A to operate in the unloading mode. In the example of FIG. 2A accumulated liquid AL flows into the gas separator 33A to obtain amounts of liquid L and gas G. The liquid L obtained from the accumulated liquid AL is directed to pump 39A where it is pressurized, and then into bore 20A via the fluids handling circuit 47A. As discussed above, one-way valves 45A, 71A prevent the flow of pressurized liquid L by pump 39A from flowing to the inlet 44A or to the compressor 55A. In an example, a pressurized liquid flow path is defined along the route taken by pressurized liquid $L_P$ between the discharge of the pump 39A and to the outlet 48A.

In the example of FIG. 2B an amount of the accumulated liquid AL has been removed during the unloading mode of FIG. 2A so that liquid level LL is below perforations 15A. In a non-limiting example of operation, conditions in the wellbore 11A dictate that the unloading mode of the downhole assembly 17A is suspended, and that the downhole assembly 17A operate in the production mode. In the example of a production mode as shown in FIG. 2B, gas G flows from within the wellbore 11A to the bore 20A of production tubing 19A. In this example of the production mode, pressure of gas G within wellbore 11A is sufficient to flow into inlet 44A, past one-way valve 46A in line 42A, to outlet 48A, and up the string of production tubing 19A to the wellhead assembly 21 of FIG. 1. In an example, a gas flow path is defined along the route taken by gas G from the wellbore 11A and to the outlet 48A. One-way valves 45A, 71A block flow of the gas G back to the pump 39A and compressor 55A. For the purposes of discussion herein, the wellbore 11A is operating in a passive production mode when pressure of gas G in wellbore 11A is at a magnitude to overcome the gravitational and frictional losses encountered while being handled by the downhole system 9A and reach wellhead assembly 21 (FIG. 1A) on surface S at or above a designated pressure. In this example a designated pressure of the gas G at the wellhead assembly 21A is such that the gas G is at a pressure adequate to direct the gas G to a desired destination without additional pressurization. It is within the capabilities of one skilled in the art to identify a designated pressure of the gas G at surface S. In an embodiment, compressor 55A is not operating and in a standby mode during the passive production mode.

An alternative production mode occurs when pressure of gas G in wellbore 11A is insufficient to flow to the wellhead assembly 21A and gas G is pressurized by compressor 55A; which for the purposes of discussion is referred to as an active production mode. In this example, compressor 55A is activated by energizing compressor motor 59A which then draws gas G through inlet 66A, into line 65A across valve 69A and into compressor 55A where the gas G is pressurized within compressor 55A and discharged into the compressor discharge line 67A as pressurized gas $G_P$. The pressurized gas $G_P$ is then routed to bore 20A through the fluids handling circuit 47A and follows the same route as the gas G in the passive operating mode. Similar to the other operating modes discussed within, valves 46A, 45A prevent flow of gas pressurized by compressor 55A from entering wellbore 11A through the gas feed line 42A or back to the pump 39A through the pump discharge line 40A. In an example, a pressurized gas flow path is defined along the route taken by pressurized gas $G_P$ between the discharge of the compressor 55A and to the outlet 48A.

Another alternative production mode is illustrated in FIG. 2C where a combination of liquid L and gas G is being directed within bore 20A of production tubing 19A and to wellhead assembly 21A; and for the purposes of discussion this production mode is referred to as a mixed production mode. In an embodiment of the mixed production mode the pump 39A is operating in conjunction with production of gas G through the gas feed line 42A. In another embodiment of the mixed production mode, the pump 39A operates in conjunction with operation of the compressor 55A as discussed above. In this example, the motor 39A is operated such that the pressurized liquid $L_P$ at the junction 43A is substantially that of pressure of pressurized gas $G_P$ at junction 43A so that the combined flows of pressurized liquid $L_P$ and pressurized gas $G_P$ make up a combined flow up the bore 20A.

An example controller 75 is schematically illustrated in FIGS. 1A and 1B which is in communication with the downhole assembly 17 via communication means 77. Similarly, controller 75A and communication means 77A are in communication with the downhole assembly 17A of embodiments shown in FIGS. 2A through 2C. In a non-limiting example of operation, a mode of operation is suspended in response to the liquid level LL within wellbore 11, 11A. In another non-limiting example of operation, a mode of operation is initiated in response to the liquid level LL in wellbore 11, 11A. Examples exist where the liquid level LL triggering suspension of or activation of a mode of operation is above the perforations 15, 15A (i.e. between perforations 15, 15A and packer 23, 23A), adjacent the perforations 15, 15A, or below the perforations 15, 15A (i.e. on a side of perforations 15, 15A opposite the packer 23, 23A). In an example, a liquid level LL established that triggers suspension or activation of a mode of operation is referred to as a designated liquid level. A further example exists where sensors (not shown) are disposed in the wellbore 11, 11A for monitoring when the liquid level LL reaches a designated level. Signals for communicating between the controller 75, 75A and downhole assembly 17, 17A are optionally delivered via power cables 25, 25A, 73A. Examples of communication means 77, 77A include hardwired, wireless, telemetry, and fiber optics. In an alternative, an information handling system ("IHS") is included within controller 75, 75A. In an example, IHS is in communication with the sensors, and determines when and if to generate a command initiating operation of the pump 39, 39A and/or compressor 55A. In an example, IHS includes one or more of a processor, memory accessible by the processor, non-volatile storage area accessible by the processor, and logics for performing each of the steps above described. Further examples exist where the rate at which accumulated liquid AL increases within wellbore 11, 11A is monitored and where the operational modes of unloading may then be triggered at a liquid level LL that is different from situations of a lower rate of increase.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A downhole system for handling fluids in a well comprising:

a submersible pump having a pump inlet in communication with liquid in the well and a pump discharge selectively at a pressure that is greater than a pressure at the pump inlet;

a cross-over bulkhead; and a fluids handling circuit inside the cross-over bulkhead and comprising, a pump discharge line having an inlet in fluid communication with the pump discharge and an exit in selective communication with a bore that is inside of production tubing installed in the well, a gas feed line having an inlet formed through a radial sidewall of the cross-over bulkhead and that is in communication with gas in the well, and the gas feed line having an outlet in selective communication with the bore, a barrier to a flow from the gas feed line to the pump, and a barrier to a flow of a fluid from the pump discharge line to the inlet of the gas feed line.

2. The system of claim 1, wherein the barrier between a flow in the gas feed line to the pump comprises a one-way valve in the pump discharge line, and wherein the barrier between a flow of a fluid in the pump discharge line to the inlet of the gas feed line comprises a one-way valve in the gas feed line.

3. The system of claim 2, wherein the one-way valve in the pump discharge line is selectively openable when a pressure in the pump discharge line is at least as great as a pressure in the gas feed line so that fluid discharged from the pump flows into the bore to define an unloading mode.

4. The system of claim 2, wherein the one-way valve in the gas feed line is selectively openable when a pressure in the gas feed line is at least as great as a pressure in the pump discharge line so that fluid in the gas feed line flows into the bore to define a production mode.

5. The system of claim 4, wherein the fluid in the pump discharge line comprises water accumulated in the well, and wherein the system is in the production mode when the water in the well is below a first designated liquid level, and wherein the system is in the unloading mode when the water in the well is above a second designated liquid level.

6. The system of claim 1, wherein the exit of the pump discharge line and outlet of the gas feed line intersect at a junction inside of the crossover bulkhead.

7. The system of claim 1, further comprising a compressor having a compressor inlet in fluid communication with gas in the well through a compressor inlet line disposed in a lower bulkhead, and a compressor discharge that is selectively at a pressure greater than a pressure in the well, and wherein the fluids handling circuit further comprises a compressor discharge line having an end in communication with the compressor discharge and that is in fluid communication with the bore.

8. The system of claim 7, further comprising a barrier to a flow from the gas feed line to the compressor, and a barrier to a flow of a fluid from the pump discharge line to the compressor.

9. The system of claim 7, wherein a fluid flowing in the bore comprises fluid from two or more of fluid flowing through the gas inlet line, fluid being discharged from the compressor, and fluid being discharged from the pump.

10. A downhole system for handling fluids in a well comprising:

a submersible pump having a liquid inlet in fluid communication with liquid in the well;

a cross-over bulkhead mounted between the submersible pump and a production tubular installed in the well;

a gas feed line having a gas inlet formed through a sidewall of the cross-over bulkhead and that is in fluid communication with gas in the well; and a fluids handling circuit disposed within the cross-over bulkhead and comprising, an upstream end in communication with a discharge of the submersible pump and an end of the gas feed line distal from the inlet of the gas feed line, a downstream end in communication with the upstream end and also in communication with a bore of the production tubular, and barriers that block a flow of fluid from within the fluids handling circuit to the gas inlet and to the submersible pump.

11. The system of claim 10, wherein the pump is driven by a pump motor, and wherein pressure in the motor is equalized to pressure in the well with a pump seal, and wherein the pump, pump motor, and pump seal define an electrical submersible pumping assembly, the system further comprising a pod circumscribing a portion of the pumping assembly to define a cavity, and wherein fluid discharged from the pump flows through a pump discharge line that is routed through the pod.

12. The system of claim 10, wherein the inlet of the gas feed line is flush with an outer surface of the cross over assembly.

13. The system of claim 10, further comprising a compressor having a compressor inlet in communication with gas in the well, a compressor exit in communication with the fluids handling circuit, a barrier that blocks flow from the fluids handling circuit to the exit, and wherein the compressor is selectively operated in a standby mode so that pressure at the compressor exit and inlet are substantially the same, selectively operated in a first operational mode so that pressure at the compressor exit exceeds a pressure at the compressor inlet, and selectively operated in a second operational mode so that pressure at the compressor exit exceeds a pressure at the compressor inlet and fluid in the production tubing comprises a mixture of gas discharged from the compressor and liquid discharged from the pump.

14. A method of handling fluid in a well comprising:

operating in an unloading mode by directing a pressurized liquid along a pressurized liquid flow path within a downhole assembly and to a bore of a production tubular that is installed in the well, and flowing the pressurized liquid through the bore to a wellhead assembly set over the well;

operating in a production mode when not operating in the unloading mode by directing gas from within the well and along a gas flow path within the downhole assembly and to the bore;

monitoring an amount of a liquid in the well, and operating in the production mode when a level of the liquid in the well is below a designated liquid level;

blocking a flow of the pressurized liquid from entering the gas flow path when in the unloading mode; and blocking a flow of the gas from entering the pressurized liquid flow path when in the production mode.

15. The method of claim 14, further comprising monitoring an amount of a liquid in the well, operating in the unloading mode when a level of the liquid in the well is above a designated liquid level, and wherein the pressurized liquid comprises liquid in the well that is pressurized by a pump in the well.

16. The method of claim 14, further comprising operating in a gas production mode by directing pressurized gas from within the well through a pressurized gas flow path within the downhole assembly and to the bore, blocking a flow of the pressurized gas from entering the gas flow path, and blocking a flow of the pressurized gas from entering the pressurized liquid flow path, and wherein the step of operating in the gas production mode is performed when not in the unloading mode.

17. The method of claim 16, further comprising using a pump in the well to pressurize the liquid in the well to define the pressurized liquid, using a compressor in the well to pressurize the gas.

18. The method of claim 14, further comprising operating in a mixed production mode by directing a pressurized liquid along the pressurized fluid path to the bore while also operating in the unloading mode at the same time.

19. The method of claim 14, wherein the pressurized liquid comprises hydrocarbons, water, or a combination.

* * * * *